US006444089B1

(12) United States Patent
Hollmark et al.

(10) Patent No.: US 6,444,089 B1
(45) Date of Patent: Sep. 3, 2002

(54) METHOD OF PRODUCING A PAPER HAVING A THREE-DIMENSIONAL PATTERN AND PAPER PRODUCED BY THE METHOD

(75) Inventors: Holger Hollmark, Linnégatan; Lennart Reiner, Tage Erlandergatan; Thomas Billgren, Kullavik; Kaveh Tondkar, Wieselgrensplatsen; Mats Söderberg, Bågevägen; Bengt Järrehult, Repslagaregatan, all of (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/822,267

(22) Filed: Apr. 2, 2001

Related U.S. Application Data

(63) Continuation of application No. PCT/SE99/01721, filed on Sep. 29, 1999.

(30) Foreign Application Priority Data

Oct. 1, 1998 (SE) ..... 9803359

(51) Int. Cl.[7] ..... D21F 11/00; D21F 3/02; D21H 27/02; C09J 1/00

(52) U.S. Cl. ..... 162/109; 162/117; 162/206; 162/164.1; 162/164.6; 162/168.2; 162/113; 34/400; 34/445; 34/398; 156/160

(58) Field of Search ..... 162/109, 111, 162/113, 117, 205, 206, 207, 361, 362, 358.5, 164.1–164.6, 168.1–168.3, 166, 169, 175, 179; 34/397–400, 419, 444, 423–426, 442, 446; 156/160

(56) References Cited

U.S. PATENT DOCUMENTS

| | | | | | |
|---|---|---|---|---|---|
| 4,324,613 | A | * | 4/1982 | Wahren | 162/111 |
| 5,404,654 | A | * | 4/1995 | Babinsky et al. | 34/122 |
| 5,439,559 | A | * | 8/1995 | Crouse | 162/358.5 |
| 5,598,642 | A | * | 2/1997 | Orloff et al. | 34/388 |
| 6,049,998 | A | * | 4/2000 | Crouse et al. | 34/445 |
| 6,223,450 | B1 | * | 5/2001 | Banerjee | 34/116 |
| 6,309,512 | B1 | * | 10/2001 | Bengtsson et al. | 162/358.5 |

FOREIGN PATENT DOCUMENTS

| | | |
|---|---|---|
| EP | 0 490 655 | 6/1992 |

* cited by examiner

*Primary Examiner*—Jose Fortuna
(74) *Attorney, Agent, or Firm*—Young & Thompson

(57) ABSTRACT

Method of producing a paper having a three-dimensional pattern of alternating raised and recessed portions which is given the paper in connection with impulse drying. The paper web has a varying material composition as seen in its thickness direction, so that it at least in an outer layer contains an amount of a material that softens, melts or hardens in the temperature interval 100–400° C. or in some other way contributes in stabilizing the pattern structure that has been given the paper. It is further referred to an impulse dried paper produced according to the method.

11 Claims, 4 Drawing Sheets

METHOD OF PRODUCING A PAPER HAVING A THREE-DIMENSIONAL PATTERN AND PAPER PRODUCED BY THE METHOD

This is a continuation of co-pending international application No. PCT/SE99/01721 filed on Sep. 29, 1999, which designated the United States of America.

TECHNICAL FIELD

The present invention refers to a method of producing a paper having a three-dimensional pattern of alternating raised and recessed portions, which have been provided in connection with impulse drying, at which the wet paper web is passed through at least one press nip comprising a rotatable roll which is heated and that the paper web during the passage through the press nip is given a three-dimensional pattern of alternating raised and recessed portions either by means of a patterned wire and/or by a pattern on the heated roll and where said pattern is pressed into the paper web against a counter means. The invention further refers to a paper produced by the method.

BACKGROUND OF THE INVENTION

Moist paper webs are usually dried against one or more heated rolls. A method which is commonly used for tissue paper is so called Yankee drying. At Yankee drying the moist paper web is pressed against a steam-heated Yankee cylinder, which can have a very large diameter. Further heat for drying is supplied by blowing of heated air. If the paper to be produced is soft paper the paper web is usually creped against the Yankee cylinder. The drying against the Yankee cylinder is preceded by a vacuum dewatering and a wet pressing, in which the water is mechanically pressed out of the paper web.

Another drying method is so called through-air-drying (TAD). In this method the paper is dried by means of hot air which is blown through the moist paper web, often without a preceding wet pressing. The paper web which enters the through-air-dryer is then only vacuum dewatered and has a dry content of about 25–30% and is dried in the through-air-dryer to a dry content of about 65–95%. The paper web is transferred to a special drying fabric and is passed over a so called TAD cylinder having an open structure. Hot air is blown through the paper web during its passage over the TAD cylinder. Paper produced in this way, mainly soft paper, becomes very soft and bulky. The method however is very energy-consuming since all water that is removed has to be evaporated. In connection with the TAD drying the pattern structure of the drying fabric is transferred to the paper web. This structure is essentially maintained also in wet condition of the paper, since it has been imparted to the wet paper web. A description of the TAD technique can be found in e.g. U.S. Pat. No. 3,301,746.

Impulse drying of a paper web is disclosed in e.g. SE-B-423 118 and shortly involves that the moist paper web is passed through the press nip between a press roll and a heated roll, which is heated to such a high temperature that a quick and strong steam generation occurs in the interface between the moist paper web and the heated roll. The heating of the roll is e.g. accomplished by gas burners or other heating devices, e.g. by means of electromagnetic induction. By the fact that the heat transfer to the paper mainly occurs in a press nip an extraordinarily high heat transfer speed is obtained. All water that is removed from the paper web during the impulse drying is not evaporated, but the steam on its way through the paper web carries along water from the pores between the fibers in the paper web. The drying efficiency becomes by this very high.

In EP-A-0 490 655 there is disclosed the production of a paper web, especially soft paper, where the paper simultaneously with impulse drying is given an embossed surface. This embossment is made by pressing a pattern into the paper from one or both sides against a hard holder-on. This gives a compression of the paper and by this a higher density in certain portions just opposite the impressions and a lower density in the intermediate portions.

In DE-A-26 15 889 there is disclosed a thermobonded embossed soft paper. Thermoplastic fibers are added to the paper web and after drying thereof the paper web is heated to a temperature exceeding the softening temperature of the thermoplastic fibers. Simultaneously with this heating the paper is pattern embossed. Through-air-drying is mentioned as a drying method.

The object of the present invention is to provide a method of producing an impulse dried paper having a three-dimensional pattern, e.g. a soft paper intended as toilet paper, kitchen rolls, paper handkerchiefs, table napkins and the like, and where the paper has a high bulk, high elasticity and a high softness. The paper structure should essentially be maintained also in wet condition. This has according to the invention been provided by the fact that the paper web is formed with a varying material composition as seen in its thickness direction, and that it at least in the layer(s) intended to be closest to the heated roll contains an amount of a material that softens, melts or hardens in the temperature interval 100–400° C. or in some other way contributes in stabilizing the pattern structure that has been given the paper.

The invention also refers to an impulse dried paper provided with a three dimensional pattern with alternating raised and recessed portions, which have been provided in connection with the impulse drying, and where the paper has a varying material composition as seen in its thickness direction, and that it at least in an outer layer contains an amount of a material that softens, melts or hardens in the temperature interval 100–400° C. or in some other way contributes in stabilizing the patterned structure that has been given the paper, at which said material has been activated during the impulse drying.

It is by this possible to optimize the qualities of the paper in such a way that the paper at least in an outer layer contains a material which contributes in the structural stability of the paper also in wet condition, but where the composition of the paper otherwise can be optional and chosen in order to give the best possible functional qualities to the paper, such as softness, absorption, draping qualities and/or strength.

Further features and advantages of the invention are disclosed in the following description and in the dependant claims.

BRIEF DESCRIPTION OF THE DRAWINGS

The invention will in the following be closer described with reference to some embodiments shown in the accompanying drawings.

DESCRIPTION OF THE INVENTION

Figure 1:
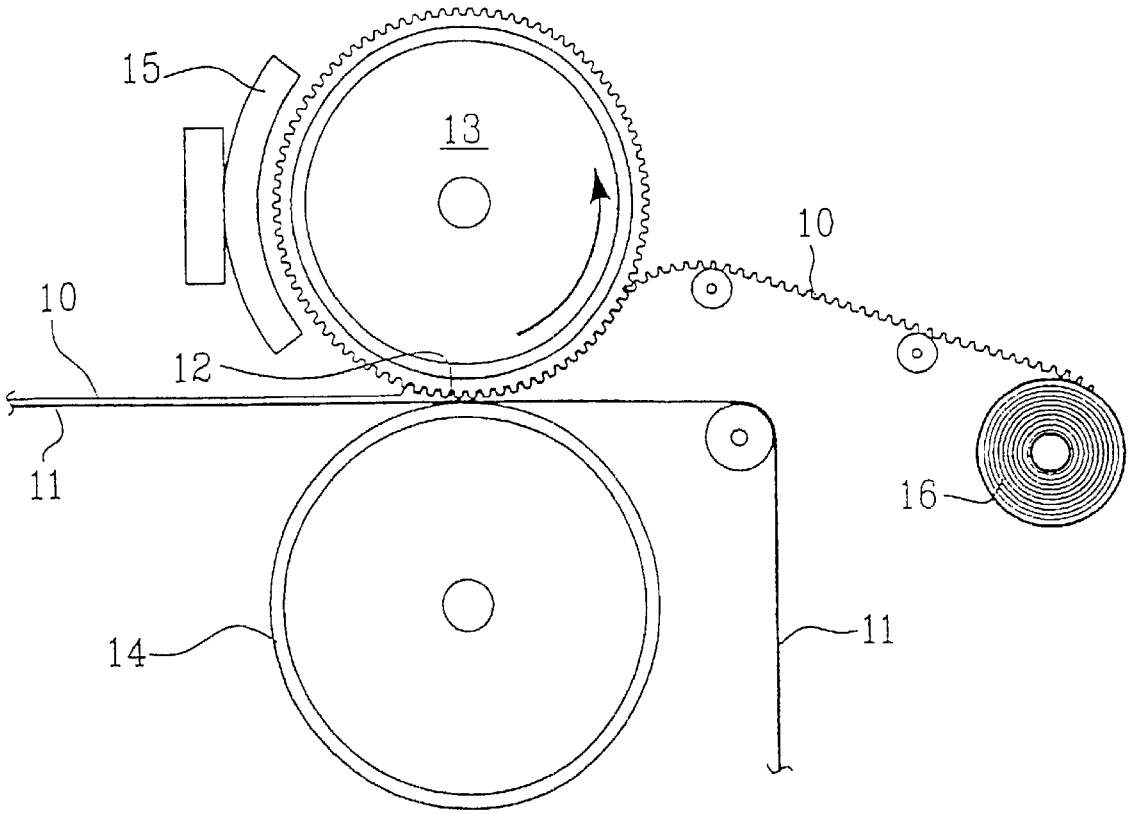
FIGS. 1–4 are schematic side views of an impulse drying device according to some different embodiments.

FIG. 1 shows schematically a device for performing impulse drying of a paper web.

The wet paper web 10 which is dewatered over suction boxes (not shown) is supported by a wire or felt 11 and is brought into a press nip 12 between two rotatable rolls 13 and 14, at which the roll 13 which is in contact with the paper web is by a heating device 15 heated to a temperature which is sufficiently high for providing drying of the paper web. The surface temperature of the heated roll can vary depending on such factors as the moisture content of the paper web, thickness of the paper web, the contact time between the paper web and the roll and the desired moisture content of the completed paper web. The surface temperature should of course not be so high the paper web is damaged. An appropriate temperature should be in the interval 100–400° C., preferably 150–350° C. and most preferably 200–350° C.

The paper web is pressed against the heated roll 13 by means of the roll 14. The press device may of course be designed in many other ways. Two and more press devices may also be arranged after each other. The holder-on 14 may also be a press shoe. It is also possible that the paper web 10 is passed into the press nip unsupported, i.e. not supported by any wire or felt.

A very rapid, violent and almost explosive steam generation takes place in the interface between the heated roll 13 and the moist paper web, at which the generated steam on its way through the paper web carries away water. For a further description of the impulse drying technique reference is made to the above mentioned SE-B-423 118 and e.g. to EP-A-0 337 973 and U.S. Pat. No. 5,556,511.

The paper is after drying wound on a wind-up roll 16. If desired the paper can be creped before winding. It is however noted that the need for creping the paper in order to impart softness and bulk which is aimed at for soft paper, is reduced when using the impulse drying method according to the invention, since the paper by the three-dimensional structure and the chosen pattern is imparted bulk and softness.

The paper web can before it is brought into the impulse dryer either can be only dewatered over suction boxes or besides slightly pressed according to a conventional process.

Simultaneously with the impulse drying the paper is given a three-dimensional structure. This can be made as shown in FIG. 1 by the fact that the heated roll 13 is provided with an embossing pattern consisting of alternating raised and recessed areas. This structure is substantially maintained also in a later wetted condition of the paper, since it has been imparted the wet paper web in connection with drying thereof. Since the term embossing is normally used for a shaping performed on dried paper we have in the following used the term press moulding for the three-dimensional shaping of the paper that occurs simultaneously with the impulse drying. By this press moulding the bulk and absorption capacity of the paper is increased, which are important qualities for soft paper.

The paper can be pressed against a non-rigid surface, i.e. a compressible press felt 11. The roll 14 can also have an elastically yielding surface, e.g. an envelope surface of rubber. The paper is herewith given a three-dimensional structure the total thickness of which is greater than the thickness of the unpressed paper. By this the paper is imparted a high bulk and by that a high absorption capacity and a high softness. Besides the paper will be elastic. At the same time a locally varying density is obtained in the paper.

The paper can also be pressed against a hard surface, e.g. a wire 11 and/or a roll 14 having a hard surface, at which the pattern of the heated roll 13 is pressed into the paper web under a heavy compression of the paper just opposite the impressions, while the portions therebetween are kept uncompressed.

Figure 2:
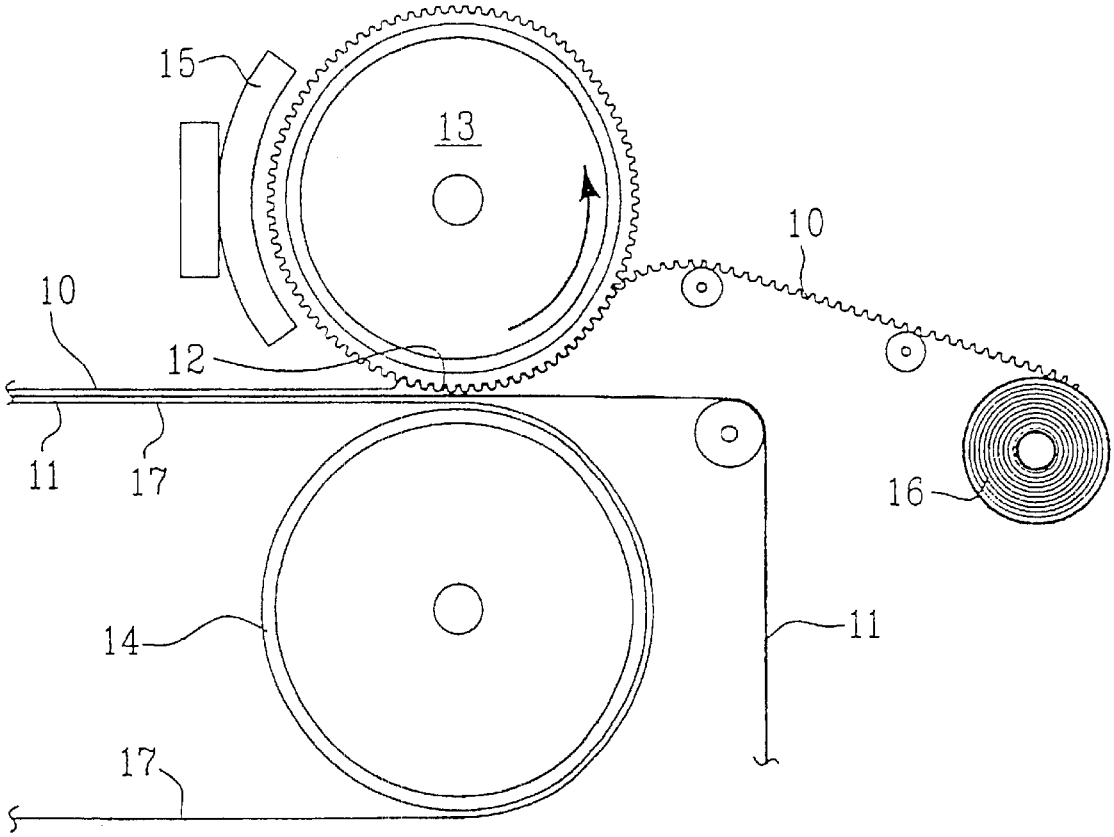

The embodiment shown in FIG. 2 differs from what is shown in FIG. 1 by the fact that under the wire 11 there is arranged a felt 17, which extends around the roll 14. The function of the felt 17 is to improve the dewatering effect and extend the press nip.

Figure 3:
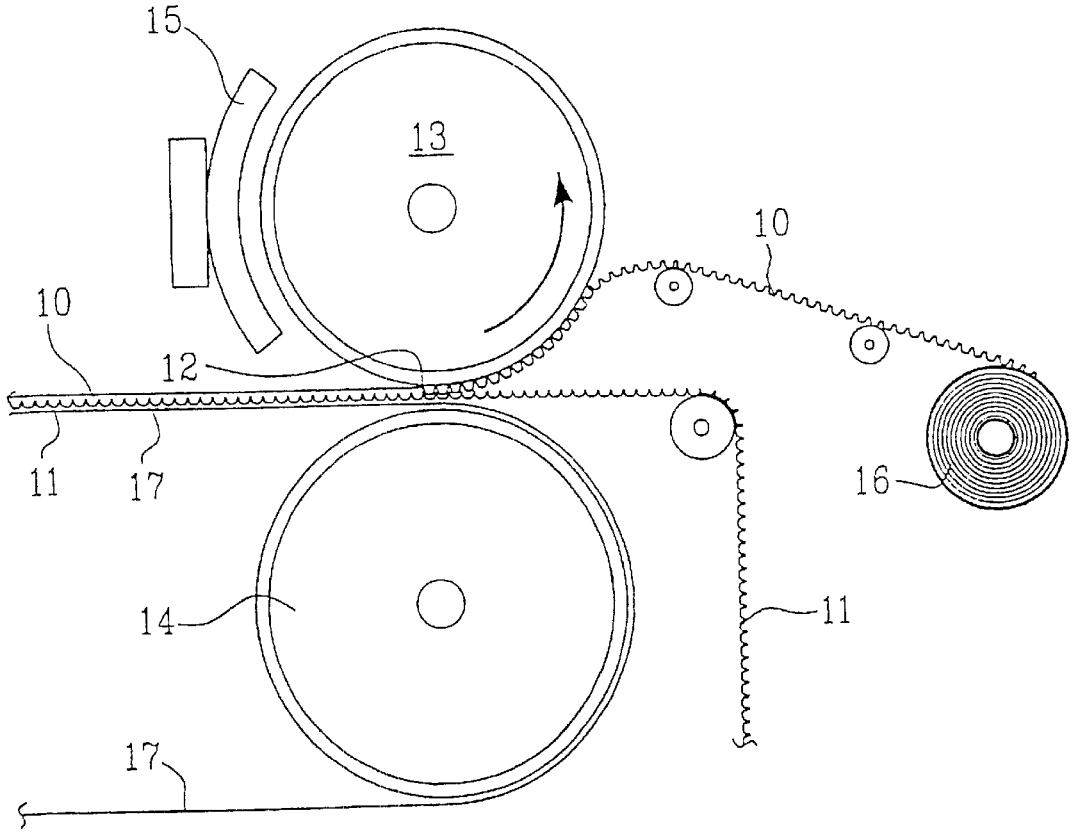

According to the embodiment shown in FIG. 3 the paper web 10 is during the drying supported by a wire 11 having a pattern, which is press moulded into the paper web when this passes through the press nip 12 between the rolls 13 and 14. The roll 13 can either be smooth, as is shown in FIG. 3, or have an embossing pattern. In the case the roll 13 is smooth the press moulded paper will have one smooth surface and one surface with impressions. In the case the roll 13 has an embossing pattern this will also be pressed into the paper, which thus on one side will have a pattern corresponding to the structure of the wire 11 and on the opposite side having a pattern corresponding to the embossing pattern of the roll. The pattern may but need not coincide and/or be the same or different.

Figure 4:
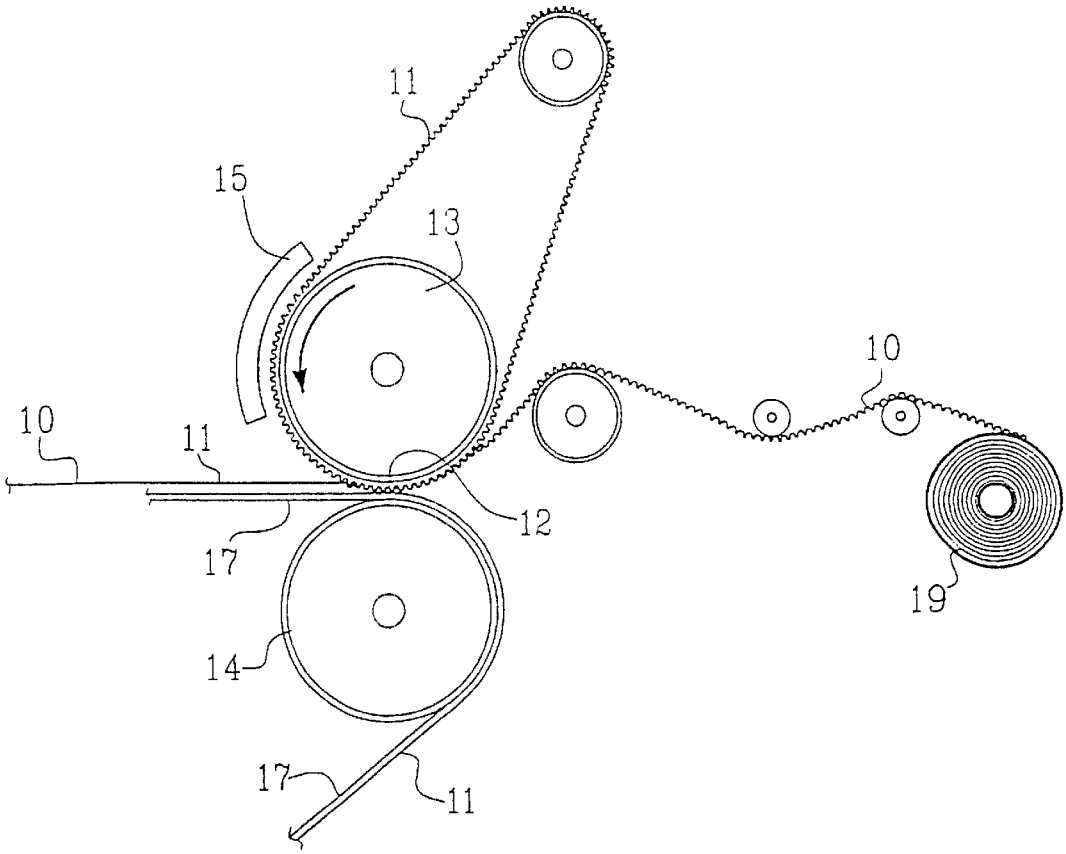

According to the embodiment shown in FIG. 4 the three-dimensional pattern in the paper web is produced by a pattern band or belt 11, which extends around and is heated by the cylinder 13. The pattern of the band 11 is press moulded into the paper web as this passes through the press nip 12 between the rolls 13 and 14. The paper web is supported by a felt 17 through the press nip.

According to the invention the paper web has a varying material composition as seen in its thickness direction, in such a way that it at least in the layer(s) that will be located closest to heated roll 13 in connection with the impulse drying contains a certain amount of a material which softens, melts or hardens in the temperature interval 100–400° C. By this the paper will get a surface layer which contributes in reinforcing the structural stability of the paper also in wet condition. The pulp composition in the rest of the paper layers can on the other hand be chosen for optimizing other properties such as softness, strength, bulk and draping qualities.

Said material which in connection with impulse drying softens, melts or hardens can consist of a wet strength agent, synthetic or natural polymers with thermoplastic properties, chemically modified lignin and/or synthetic or natural polymers in the presence of softening agents or of a lignin-containing high yield pulp.

The wet strength agent, which hardens at high temperatures, can consist of a polyamide amine epichlorhydrine resin, polyacryl amide resin, acrylic emulsion, urea formaldehyde resin, polythene imine resin, a modified starch and/or a modified cellulose derivative. The content of wet strength agent in the layer which is intended to be located closest to the heated roll 13 should be at least 0.05 weight % calculated on the dry fiber weight.

Examples of materials that softens or melts in the temperature interval 100–400° C. are synthetic or natural polymers with thermoplastic properties, chemically modified lignin and/or synthetic or natural polymers in the presence of softening agents. The material can either be in the form of powder, flakes, fibers or an aqueous suspension, e.g. a latex dispersion. Examples of thermoplastic polymers are polyolefines such as polyethylene and polypropylene, polyesters etc.

The material can be added in the paper making process together with the pulp fibers before forming and dewatering the paper web. It can also be added in the form of a suspension which is brought to flow out on the forming wire through a separate headbox arranged either before or after the headbox for the pulp suspension. Alternatively the material may in the form of a suspension be added through a certain section in a multilayer headbox and where the pulp suspension is added through the other sections of the multilayer headbox.

It is also possible to add the material to the formed paper web in the form of a liquid suspension through spraying or through contact with a rotating transfer roll.

In case the material is printed on the formed paper web by a transfer roll it is possible that the material is printed in a pattern essentially corresponding to the pattern of the heated roll 13 in the form of raised and recessed portions, so that the paper web will contain the softening or melting material only in the portions thereof which will be in contact with the raised portions of the roll 13.

By adding to the paper web said material, which is brought to soften or melt, there is achieved an increased amount of bonding sites in the paper web. By this the basis weight variation and three-dimensional structure, that has been imparted to the paper web in connection with the combined impulse drying and press moulding, is effectively permanented. This structure is maintained also in the wet condition of the paper.

An important advantage of the invention is that drying, thermobonding and pattern embossing takes place in one and the same step—the impulse drying step—at which there is achieved a more stable paper structure with a low degree of inner stresses, which otherwise will easily occur if the paper is dried and the fibrous structure by this is locked before the thermobonding.

As mentioned above the softening or melting material according to the invention may also consist of a lignin containing high yield pulp, which will be described more in detail below.

Paper can be produced by a number of different pulp types. If one disregards recovery pulp, which today is used to a great extent mainly for toilet paper and kitchen rolls, the most commonly used pulp type for soft paper is chemical pulp. The lignin content in such pulp is practically zero and the fibers, which mainly consist of pure cellulose, are relatively thin and flexible. Chemical pulp is a low yield pulp since it gives a yield of only about 50% calculated on the wooden raw material used. It is therefore a relatively expensive pulp.

It is therefore common to use cheaper so called high yield pulps, e.g. mechanical, thermomechanical pulp, chemomechanical pulp (CMP) or chemothermomechanical pulp (CTMP) in soft paper as well as in other types of paper, e.g. newsprint paper, cardboard etc. In high yield pulps the fibers are coarser and contain a high amount of lignin, resins and hemicellulose. The lignin and the resins gives the fibers more hydrophobic properties and a reduced ability to form hydrogen bonds. The addition of a certain amount of chemothermomechanical pulp in soft paper has due to the reduced fiber-fiber bonding a positive effect on properties like bulk and absorption capacity.

A special variant of chemothermomechanical pulp (CTMP) is so called high temperature chemothermomechanical pulp (HT-CTMP), the production of which differs from the production of CTMP of conventional type mainly by using a higher temperature for impregnation, preheating and refining, preferably no lower than 140° C. For a more detailed description of the production method for HT-CTMP reference is made to WO 95/34711. Characterizing for HT-CTMP is that it is a long fibrous—, easily dewatered— and bulky high yield pulp with a low shives content and low fines content.

It has according to the invention been found that high yield pulp is especially suitable for impulse drying since it is pressure insensitive, easily dewatered and has an open structure which admits the generated steam to pass through. This minimizes the risk for the paper to be overheated and destroyed during the impulse drying, which is performed at considerably higher temperatures than in other drying methods. The pressure insensitivity and the open structure depends on that the fibers in high yield pulp are relatively coarse and stiff as compared to the fibers in chemical pulp.

Impulse drying takes place at a considerably higher temperature than e.g. Yankee drying or through-air-drying, at which according to a theory, to which however the invention is not bound, the softening temperature of the lignin present in the high yield pulp is reached during the simultaneous impulse drying and press moulding. When the paper becomes cooler the lignin stiffens again and contributes in permanenting the three-dimensional structure that has been given the paper. This is therefore essentially maintained also in the wet condition of the paper, which strongly improves the bulk and absorption qualities of the paper.

According to one embodiment of the invention the paper contains, at least in the layer(s) which is/are located closest to the heated rolls 13 during the impulse drying, a certain amount of a high yield pulp, said amount should be at least 10 weight % calculated on the dry fiber weight, preferably at least 30 weight % and more preferably at least 50 weight %. Other layers may contain any optional pulp or combination of different types of pulp in order to give desired qualities such as softness, strength, bulk etc. So does for example chemical pulp, preferably long-fibrous kraft pulp, provide a high strength of the paper. Recycled pulp may of course also be contained in the paper.

The paper web is in this case formed in at least two separate layers, either by means of a multilayer headbox or by two or more consecutive headboxes, at which the pulp composition in at least two layers are different.

It is of course also possible to combine different types of the above stated materials such as lignin-containing high yield pulp and wet strength agent and melting of softening materials respectively, in order to further reinforce the stabilizing effect of the pattern structure of the paper.

In all cases it is also possible to let the moist paper web pass through at least two consecutive press nips 12 each comprising a rotatable roll 13 which is heated and provided with a pattern of alternating raised and recessed portions intended to be pressed into the paper web against a holder-on. The second press nip is in this case preferably reversed as compared to the first press nip, at which one side of the paper web attains the highest temperature in the first press nip while the other side attains the highest temperature in the second press nip.

The paper web is in this case formed in at least three separate layers, at which the two outer layers each contains a certain amount of said material that softens, melts or hardens in the temperature interval 100–400° C., such as a lignin-containing high yield pulp, a wet strength agent, synthetic or natural polymers with thermoplastic properties, chemically modified lignin and/or synthetic or natural polymers in the presence of softening agents.

Common additives such as wet strength agents, softening agents, fillers etc may of course also be used in the paper. The paper web can after impulse drying undergo different types of per se known treatments such as addition of different chemicals, further embossing, lamination etc. It is also possible when transferring the paper web between two different wires, e.g. from a dewatering wire to a drying wire, to have a speed difference between the wires so that the paper web is slowed down in connection with the transfer. The paper web will then be compacted to a certain extent, which further increases the softness qualities.

What is claimed is:

1. Method of producing a paper having a three-dimensional pattern of alternating raised and recessed portions, by impulse drying, comprising the steps of:

passing the wet paper web through at least one press nip having a rotatable heated roll; and pressing a three-dimensional pattern of alternating raised and recessed portions into the wet paper web during passage through the press nip using one of a patterned wire and a pattern on the heated roll, said pattern being pressed into the wet paper web against a counter means, wherein the wet paper web has a varying material composition as seen in a thickness direction, and at least in a layer intended to be closest to the heated roll, contains an amount of a material that does one of softens, melts and hardens in the temperature interval 100–400° C. to stabilize the pattern structure that has been given the paper.

2. Method as claimed in claim 1, wherein the pattern is being pressed against a non-rigid counter means.

3. Impulse dried paper comprising a three-dimensional pattern with alternating raised and recessed portions, which have been provided in connection with the impulse drying, wherein the paper has a varying material composition as seen in a thickness direction, and at least in an outer layer contains an amount of a material that does one of softens, melts and hardens in the temperature interval 100–400° C. to stabilize the pattern structure that has been given the paper, said material being activated during the impulse drying.

4. Paper as claimed in claim 3, characterized in that said material comprises a lignin containing high yield pulp.

5. Paper as claimed in claim 4, wherein the content of lignin containing high yield pulp in the layer intended to be located closest to the heated roll is at least 10% by weight, calculated on the dry fiber weight.

6. Paper as claimed in claim 4 wherein the content of the lignin containing high yield pulp is at least 30% by weight.

7. Paper as claimed in claim 4 wherein the content of the lignin containing high yield pulp is at least 50% by weight.

8. Paper as claimed in claim 3, wherein said material comprises at least one of synthetic or natural polymers with thermoplastic properties, chemically modified lignin and synthetic or natural polymers together with softeners.

9. Paper as claimed in claim 3, characterized in that said material comprises a wet strength agent.

10. Paper as claimed in claim 9, wherein the wet strength agent is at least one of a polyamide-amine-epichlorhydrine resin, polyacryl amide resin, acryl emulsion, urea formaldehyde resin, polythene imine resin, a modified starch and a modified cellulose derivative.

11. Paper as claimed in claim 2, characterized in that it is an absorbent soft paper.

* * * * *